US005329263A

United States Patent [19]

Minami

[11] Patent Number: 5,329,263

[45] Date of Patent: Jul. 12, 1994

[54] DIRECTIONAL COUPLER WHEREIN THICKNESS OF COUPLING LINES IS SMALLER THAN THE SHIK DEPTH

[75] Inventor: Kazuaki Minami, Nagaokakyo, Japan

[73] Assignee: Murata Manufacturing Co., Ltd., Kyoto, Japan

[21] Appl. No.: 3,444

[22] Filed: Jan. 12, 1993

[30] Foreign Application Priority Data

Jan. 16, 1992 [JP] Japan ..... 4-005497

[51] Int. Cl.[5] ..... H01P 5/18

[52] U.S. Cl. ..... 333/116; 333/238

[58] Field of Search ..... 333/116, 238

[56] References Cited

U.S. PATENT DOCUMENTS 3,769,618 10/1973 Freedman et al. ..... 333/238

4,607,240 8/1986 Isota et al. ..... 333/116

*Primary Examiner*—Paul Gensler

*Attorney, Agent, or Firm*—Heller, Ehrman, White & McAuliffe

[57] ABSTRACT

An electric coupler has a dielectric substrate and a mutually parallel pair of quarter-wavelength coupling lines made of microstrip lines, formed on the top surface of the substrate separated from each other by a predetermined distance. The thickness of these coupling lines are smaller than the skin depth at a frequency at which the coupler can function as a directional coupler.

20 Claims, 3 Drawing Sheets

DIRECTIONAL COUPLER WHEREIN THICKNESS OF COUPLING LINES IS SMALLER THAN THE SHIK DEPTH

FIELD OF THE INVENTION

This invention relates to an electric coupler and, more particularly, to a directional coupler employing microstrip lines.

DESCRIPTION OF THE PRIOR ART

Directional couplers for high frequencies of a quarter-wavelength coupling line type employing microstrip lines have been proposed. A known example of such a directional coupler includes a dielectric substrate formed with a grounding conductor on its entire bottom surface and a pair of quarter-wavelength coupling lines made of microstrip lines formed on the top surface of this substrate in a mutually parallel relationship with a predetermined separation between them and with their ends connected to different ports.

The length of the pair of coupling lines as described above is determined by the wavelength associated with a frequency at which the coupler works as a directional coupler. In general, a coupler can function as a directional coupler within a certain range of frequency. This range of frequency will be hereinafter referred to as the working frequency range, and a frequency within this range will be referred to as a working frequency. Since the length of the coupling lines becomes greater as the working frequency range is decreased, the size of a directional coupler cannot be reduced beyond a certain limit predetermined by the working frequency range.

For this reason, it has been a common practice to increase the dielectric constant of the substrate so as to shorten the guide wavelength and to thereby reduce the length of the coupling lines. Moreover, these coupling lines are bent in wiring for reducing the size of the directional coupler.

In summary, although attempts have been made to reduce the size of a directional coupler by increasing the dielectric constant of the substrate, there is a limit to how much the dielectric constant can be increased by choosing a material carefully. Thus, it has been considered difficult to reduce the size to any significant degree. Moreover, if the coupling lines are bent, characteristics of the directional coupler may be adversely affected in some situations due to the coupling between the parallel coupling lines. Thus, there was also a limitation to the shape of the wiring.

SUMMARY OF THE INVENTION

Accordingly, a principal object of the present invention is to provide a directional coupler which can be made compact by adjusting the thickness of its coupling lines.

Another object of this invention is to provide a directional coupler of the type described above, which is simple in structure and capable of functioning reliably and being manufactured on a mass production basis at a low cost.

A directional coupler according to a preferred embodiment of the invention, with which the above and other objects can be accomplished, includes a dielectric substrate and a pair of coupling lines less than a quarter-wavelength long made of microstrip lines and formed on the top surface of this dielectric substrate in a mutually parallel relationship with a predetermined separation therebetween, and is further characterized in that the thickness of each of these coupling lines is smaller than the skin depth at a working frequency. The skin depth δ associated with the so-called classical skin effect (CSE) is expressed as follows:

$$\delta = 1/(\pi f \mu \sigma)^{\frac{1}{2}}$$

where f is a working frequency, and $\mu$ and $\sigma$ are respectively the permeability and the conductivity of the coupling lines.

Balancing of the output level at a working frequency may be controlled by adjusting the thickness and the length of the coupling lines. If the thickness of the coupling lines is reduced to less than the skin depth at a working frequency, the length of the coupling lines becomes smaller as the thickness is reduced. Accordingly, the directional coupler may be made even smaller by making the thickness of the coupling lines less than the skin depth at a working frequency.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

In these figures, like parts are indicated by the same numerals for convenience.

DETAILED DESCRIPTION OF THE INVENTION

Figure 1:
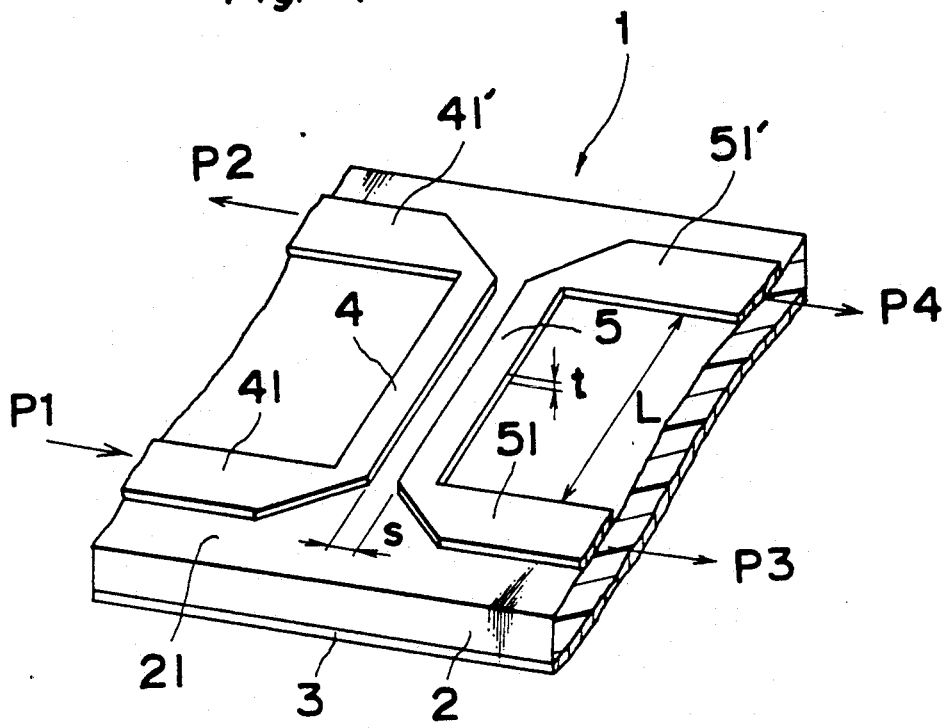
FIG. 1 is a fragmentary perspective view of a directional coupler according to a preferred embodiment of the invention.
Figure 2:
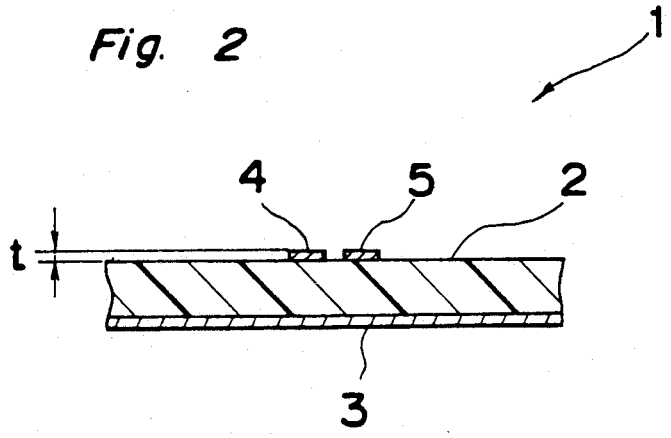
FIG. 2 is a sectional view of the directional coupler of FIG. 1 taken at its central portion.

FIGS. 1 and 2 show directional coupler 1 according to a preferred embodiment of the present invention, comprising a dielectric substrate 2 made, for example, of a ceramic material and having a high dielectric constant, a grounding conductor 3 which entirely covers its bottom surface, and a mutually parallel pair of coupling lines 4 and 5 less than a quarter-wavelength long made of microstrip lines and formed generally at a central portion on the top surface 21 of the substrate 2, separated from each other by a predetermined distance S.

The opposite ends of one of the pair of coupling lines 4 are each connected to an input port P1 and an output port P2 ("the first output port") through transmission lines 41 and 41', respectively. The opposite ends of the other of the coupling lines 5 are each connected to another output port P3 ("the second output port") and an isolation port P4 through transmission lines 51 and 51', respectively. All these transmission lines 41, 41' 51 and 51' are also made of microstrip lines and formed by a vapor deposition method using, for example, gold. The thickness t of the coupling lines 4 and 5 is made smaller than the skin depth δ associated with the classical skin effect corresponding to a working frequency. The isolation port P4 is normally terminated by a discrete resistance element having impedance equal to the characteristic impedance of the transmission line 51' such that signals transmitted therethrough may not be reflected. The length L of the coupling lines 4 and 5 is determined such that the output levels from the two output ports P2 and P3 are approximately equal to each other, or such that the coupler functions best as a directional coupler. The input frequency when the output levels from the two output ports P2 and P3 become equal will be hereinafter referred to as the center frequency $f_0$, although the center frequency may not be exactly in the middle of the aforementioned working frequency range.

As will be explained below, if the thickness t of the coupling lines 4 and 5 is made smaller than the skin depth δ at a working frequency, their length L can be made smaller as the thickness t is reduced. In other words, the directional coupler 1 can be made even smaller as a whole by properly designing the coupling lines 4 and 5 to reduce their thickness t sufficiently to less than their skin depth δ corresponding to a working frequency.

Signals inputted from the input port P1 are transmitted through the associated transmission line 41, the coupling line 4 and the transmission line 41' and outputted through the first output port P2. If the frequency of the input signal is within the working frequency range, the other coupling line 5 of the pair becomes excited and makes an output through the second output port P3.

The relationship between the thickness t and the length L of the coupling lines 4 and 5 will be explained next with reference to FIG. 3 which shows an example of characteristics of a directional coupler with the center frequency $f_0$ at 1.3 GHz and the thickness t of the coupling lines larger than the skin depth δ (about 2 μm) at $f_0 \approx 1.3$ GHz. The center frequency $f_0$ is adjusted mainly through the length L of the coupling lines 4 and 5.

Figure 3:
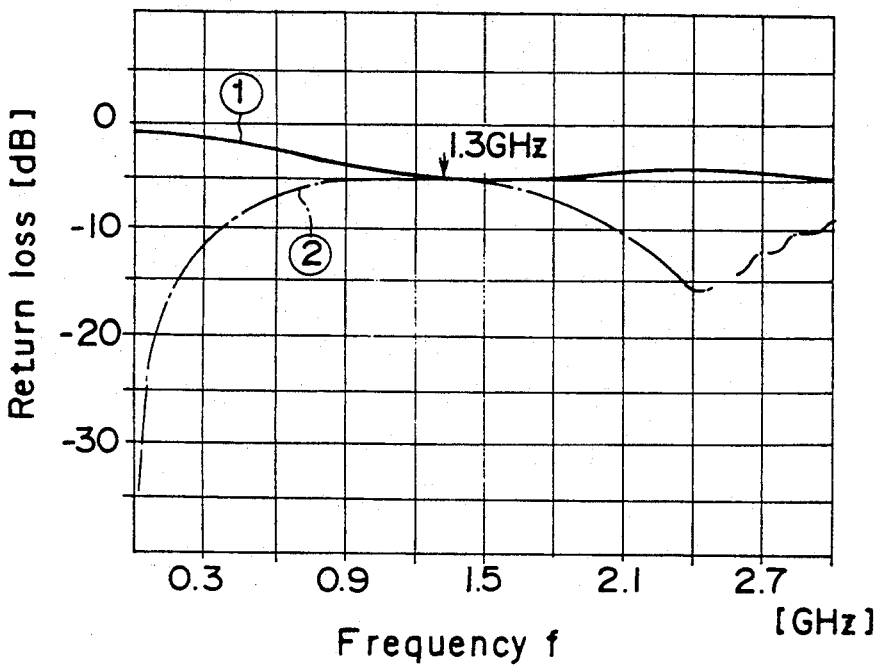
FIG. 3 is a graph showing characteristics of the directional coupler with center frequency of 1.3 GHz.

In the graph of FIG. 3, the ordinate represents the return loss (that is, the ratio between the output level and the input level) and the abscissa represents the frequency. Curve 1 represents the passing characteristic between the input port P1 and the first output port P2. Curve 2 represents the coupling characteristic between the input port P1 and the second output port P3. It is seen in FIG. 3 that Curves 1 and 2 generally coincide over a frequency range around the center frequency $f_0$ and that the output levels at the two output ports P2 and P3 are balanced.

Figure 4:
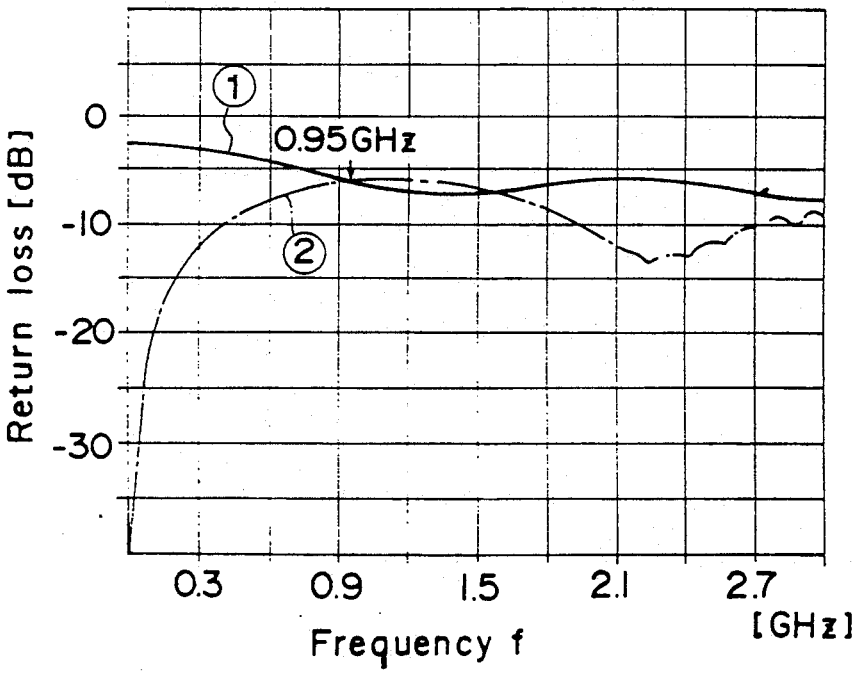
FIG. 4 is a graph showing characteristics of the direction coupler with coupling lines of reduced thickness.
Figure 5:
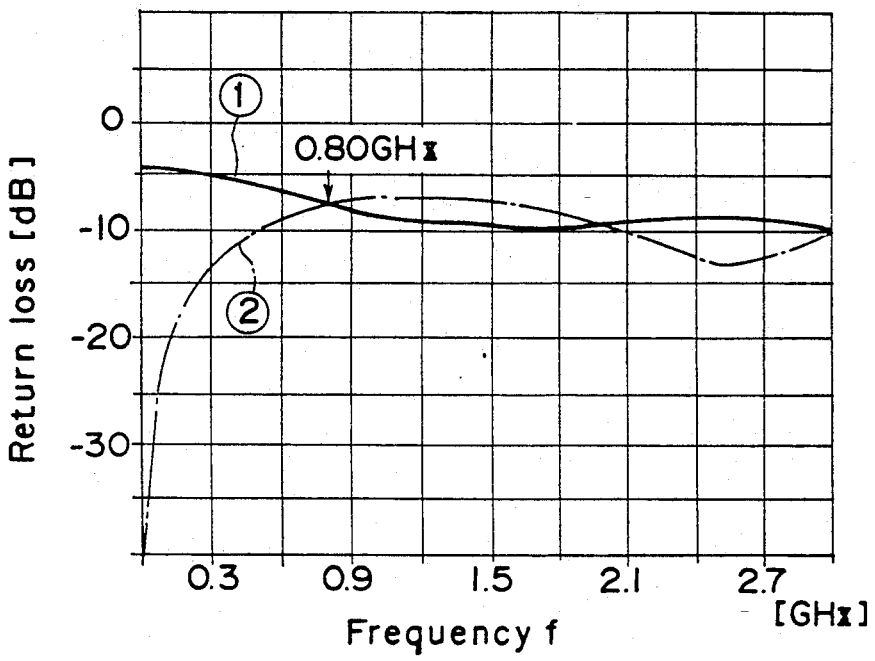
FIG. 5 is a graph showing characteristics of the direction coupler with coupling lines of even more reduced thickness.

FIG. 4 shows characteristics of another directional coupler which is similar in shape to the one represented by FIG. 3 but of which the thickness t ($\approx 0.6$ μm) of the coupling lines is less than the skin depth δ at a working frequency. FIG. 5 shows characteristics of still another directional coupler which is similar in shape to the one shown in FIG. 3 but of which the thickness t of the coupling lines is even smaller ($\approx 0.3$ μm). FIG. 4 shows that the center frequency $f_0$ drops to about 950 MHz as the thickness t of the coupling lines is reduced to 0.6 μm, the output levels of the two output ports P2 and P3 being balanced. FIG. 5 shows that the center frequency $f_0$ drops to about 800 MHz as the thickness t of the coupling lines is reduced to 0.3 μm. In other words, even if the length L of the coupling lines 4 and 5 remains the same, the center frequency $f_0$ may be reduced by properly reducing the thickness t to less than the skin depth δ corresponding to a working frequency. This means that the length L of the coupling lines 4 and 5 can be made smaller than if the thickness t is greater than the skin depth δ corresponding to a working frequency.

Figure 6:
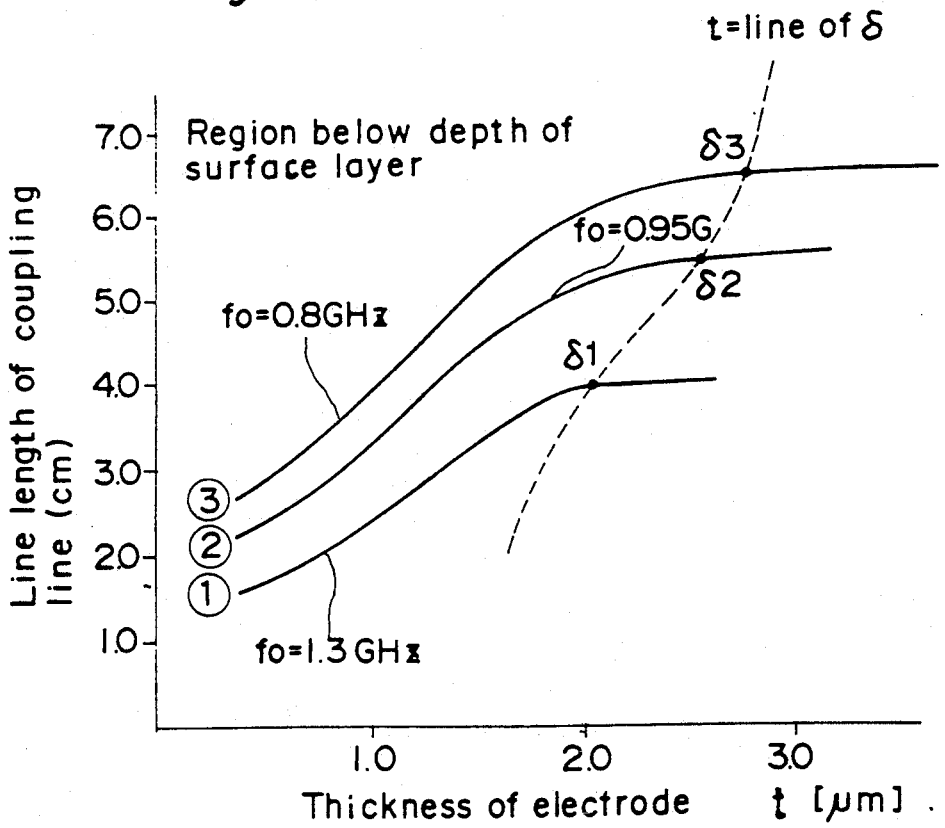
FIG. 6 is a graph showing the relationship between the thickness and the length of the coupling lines with the center frequency used as a parameter.

FIG. 6 is a graph of the relationship between the thickness t and the length L of the coupling lines 4 and 5 with the center frequency $f_0$ serving as a parameter, Curves 1, 2 and 3 respectively corresponding to $f_0 = 1.3$ GHz, 0.95 GHz and 0.8 GHz, and $\delta_1$, $\delta_2$ and $\delta_3$ respectively representing the skin depths corresponding to these center frequencies. The dotted line in FIG. 6 shows where t becomes equal to δ corresponding to a working frequency. The region on the left-hand side of this dotted line is where t is smaller than such δ, and this is where the length L becomes smaller as the thickness t is reduced. In other words, if the thickness t of the coupling lines 4 and 5 is selected in this region, their length L can be substantially reduced, and so can also be the overall size of the directional coupler.

The present invention is particularly useful with directional couplers for lower frequencies because a lower frequency corresponds to a longer wavelength and difficulties become involved if it is attempted to provide a compact directional coupler merely by adjusting the length L of its coupling lines. In such a situation, the thickness t of the coupling lines may be reduced according to the present invention such that their length can be reduced even more than for a quarter-wavelength type. Moreover, since a material such as gold is used for the microstrip lines, reduced thickness and reduced length mean a reduction in the production cost.

It is to be noted that the skin depth δ is a function of the frequency and that different frequencies within the working frequency range may be applied for the purpose of the present invention. As the frequency is varied within the working frequency range, the corresponding skin depth also changes. When the thickness t is said to be "smaller than the skin depth" therefore, it is to be interpreted as meaning "smaller than the smallest of the skin depth values corresponding to the frequency values within the working frequency range. In other words, the maximum thickness may be interpreted as corresponding to a frequency at the upper limit of the working frequency range. In practice, however, the maximum thickness may be determined as corresponding to the center frequency $f_0$, that is, the frequency at which the coupler functions best as a directional coupler, as explained above, with balanced output levels at the two output ports P2 and P3.

In summary, although the present invention has been described in general terms with reference to only one example, the specification is intended to be interpreted broadly. Many modifications and variations of the disclosed embodiment, that may be apparent to a person skilled in the art, are intended to be within the scope of the invention.

What is claimed is:

1. An electric coupler comprising:

a dielectric substrate having a top surface;

a grounding conductor covering a bottom surface of said substrate; and a mutually parallel pair of coupling lines less than a quarter-wavelength long made of microstrip lines formed on said top surface, said coupling lines being separated from each other by a predetermined distance, said coupling lines being of thickness smaller than the skin depth thereof associated with classical skin effect corresponding to a working frequency at which said electric coupler can function as a directional coupler.

2. The electric coupler of claim 1 wherein said coupling lines are of thickness smaller than the skin depth thereof corresponding to a center frequency at which said electric coupler functions as a directional coupler with said coupling lines having balanced output levels.

3. The electric coupler of claim 1 wherein said coupling lines are of thickness smaller than the skin depth thereof corresponding to any of the frequencies at which said electric coupler can function as a directional coupler.

4. The electric coupler of claim 1 wherein opposite ends of one of said coupling lines are connected each to an input port and a first output port through transmission lines made of microstrip lines, and the opposite ends of the other of said coupling lines are connected each to a second output port and an isolation port through transmission lines also made of microstrip lines.

5. The electric coupler of claim 2 wherein opposite ends of one of said coupling lines are connected each to an input port and a first output port through transmission lines made of microstrip lines, and the opposite ends of the other of said coupling lines are connected each to a second output port and an isolation port through transmission lines also made of microstrip lines.

6. The electric coupler of claim 3 wherein opposite ends of one of said coupling lines are connected each to an input port and a first output port through transmission lines made of microstrip lines, and the opposite ends of the other of said coupling lines are connected each to a second output port and an isolation port through transmission lines also made of microstrip lines.

7. The electric coupler of claim 4 wherein said isolation port is terminated by a discrete resistance element having impedance equal to the characteristic impedance of the transmission line therefor so that signals transmitted therethrough may not be reflected.

8. The electric coupler of claim 5 wherein said isolation port is terminated by a discrete resistance element having impedance equal to the characteristic impedance of the transmission line therefor so that signals transmitted therethrough may not be reflected.

9. The electric coupler of claim 6 wherein said isolation port is terminated by a discrete resistance element having impedance equal to the characteristic impedance of the transmission line therefor so that signals transmitted therethrough may not be reflected.

10. The electric coupler of claim 4 wherein said coupling lines and said transmission lines are formed by a vapor deposition method on said top surface of said dielectric substrate.

11. The electric coupler of claim 5 wherein said coupling lines and said transmission lines are formed by a vapor deposition method on said top surface of said dielectric substrate.

12. The electric coupler of claim 6 wherein said coupling lines and said transmission lines are formed by a vapor deposition method on said top surface of said dielectric substrate.

13. The electric coupler of claim 4 wherein the length of said pair of coupling lines is such that output levels from said first and second output ports at said working frequency is approximately equal to each other.

14. The electric coupler of claim 6 wherein the length of said pair of coupling lines is such that output levels from said first and second output ports at one of said any frequencies is approximately equal to each other.

15. An electric coupler comprising:

a dielectric substrate having an even top surface;

a grounding conductor covering a bottom surface of said substrate; and a mutually parallel pair of coupling lines less than a quarter-wavelength long made of microstrip lines formed on said top surface, said coupling lines being separated from each other by a predetermined distance, said coupling lines being of thickness smaller than the skin depth thereof associated with classical skin effect corresponding to a working frequency at which said electric coupler can function as a directional coupler.

16. The electric coupler of claim 15 wherein said coupling lines are of thickness smaller than the skin depth thereof corresponding to a center frequency at which said electric coupler functions as a directional coupler with said coupling lines having balanced output levels.

17. The electric coupler of claim 15 wherein said coupling lines are of thickness smaller than the skin depth thereof corresponding to any of the frequencies at which said electric coupler can function as a directional coupler.

18. The electric coupler of claim 15 wherein opposite ends of one of said coupling lines are connected each to an input port and a first output port through transmission lines made of microstrip lines, and the opposite ends of the other of said coupling lines are connected each to a second output port and an isolation port through transmission lines also made of microstrip lines.

19. The electric coupler of claim 16 wherein opposite ends of one of said coupling lines are connected each to an input port and a first output port through transmission lines made of microstrip lines, and the opposite ends of the other of said coupling lines are connected each to a second output port and an isolation port through transmission lines also made of microstrip lines.

20. The electric coupler of claim 17 wherein opposite ends of one of said coupling lines are connected each to an input port and a first output port through transmission lines made of microstrip lines, and the opposite ends of the other of said coupling lines are connected each to a second output port and an isolation port through transmission lines also made of microstrip lines.

* * * * *